US006494934B2

(12) United States Patent
Fukushima

(10) Patent No.: US 6,494,934 B2
(45) Date of Patent: Dec. 17, 2002

(54) AIR CLEANER, AIR CLEANING METHOD, AND AIR CLEANER WITH STERILIZATION

(75) Inventor: Fumio Fukushima, Tokyo (JP)

(73) Assignee: Security System Co., Ltd., Tokyo (JP)

( * ) Notice: Subject to any disclaimer, the term of this patent is extended or adjusted under 35 U.S.C. 154(b) by 0 days.

(21) Appl. No.: 09/747,717

(22) Filed: Dec. 22, 2000

(65) Prior Publication Data

US 2001/0025570 A1 Oct. 4, 2001

(30) Foreign Application Priority Data

Dec. 27, 1999 (JP) ..... 11-370348
Nov. 24, 2000 (JP) ..... 2000-357506

(51) Int. Cl.[7] ..... B03C 3/155

(52) U.S. Cl. ..... 95/63; 95/73; 95/77; 96/55; 96/94; 96/96; 96/225

(58) Field of Search ..... 95/69, 73, 77–79, 95/63; 96/40, 58, 63, 77, 94, 224, 225, 55, 96; 422/4

(56) References Cited

U.S. PATENT DOCUMENTS 2,825,102 A * 3/1958 Hicks et al. ..... 95/73 X
3,375,638 A * 4/1968 Dungler ..... 96/40 X
3,650,092 A * 3/1972 Gourdine et al. ..... 96/40
3,912,467 A * 10/1975 Trump et al. ..... 96/40 X
3,973,927 A * 8/1976 Furchner et al. ..... 95/73 X
4,035,164 A * 7/1977 Taylor ..... 95/73
4,070,163 A * 1/1978 Kolb et al. ..... 95/73
4,318,152 A * 3/1982 Weber ..... 96/77 X
4,496,375 A * 1/1985 Le Vantine ..... 96/77 X
5,055,115 A * 10/1991 Yikai et al. ..... 96/77 X
5,290,343 A * 3/1994 Morita et al. ..... 96/77 X
6,129,781 A * 10/2000 Okamoto et al. ..... 95/73 X
6,228,149 B1 * 5/2001 Alenichev et al. ..... 95/78

* cited by examiner

*Primary Examiner*—Richard L. Chiesa
(74) *Attorney, Agent, or Firm*—Baker & Daniels

(57) ABSTRACT

An air cleaner having a minus ion generator and a positive electrode. The minus ion generator carries a high minus voltage, and the positive electrode carries a high plus voltage. Preferably, the minus ion generator has a heater. The air cleaner may have an absorbing sheet positioned close to the positive electrode. Preferably, the minus ion generator is spaced apart from the positive electrode by a distance not less than a half of the maximum distance between walls of room. Preferably, the high plus voltage is not less than 4,000 Volts, and the absolute value of the high minus voltage is larger than the absolute value of the high plus voltage. Preferably, the air cleaner has a sterilizing function.

15 Claims, 5 Drawing Sheets

AIR CLEANER, AIR CLEANING METHOD, AND AIR CLEANER WITH STERILIZATION

BACKGROUND OF THE INVENTION

1. Field of the Invention

The present invention relates to an air cleaner for removing house dust and an air cleaner with a sterilization function to remove bacteria and virus from air in a room.

2. Related Art

Recently, it has been reported that one-third or one-fourth of Japanese people have an allergy. Thus, it is desired to remove house dust which is disadvantageous for persons having an allergy.

The house dust consists of minute particles floating ina room. The house dust includes those derived from mites (acarid), fine fibers, food drops, and pollen or spore of a plant. Tobacco smoke is also included in the house dust.

The airborne infection (including droplet infection) of bacteria, viruses, and the like is caused by coughs and sneezing of sick persons or carriers. Recently, it has been a social problem that a mass infection appears in a hospital, an old-aged home, and a physical care house particularly due to pathogenic microbes. The microbes include phthisis germs, derived from a carrier thereof and Legionella germs contained in droplets of a cooling water of an air-conditioner.

One of such air cleaners for removing house dust, bacteria, and virus is an electrical-discharge-type air cleaner having a minus ion generator. FIG. 5 shows an example of the air cleaner.

To provide a minus ion generator, an aerial conductive wire carrying a high minus voltage is developed, and a non-woven fabric is arranged near the wire. The non-woven fabric is grounded through a ground pole or carries a high plus voltage through a positive pole.

The house dust and bacteria which are floating in air are charged by minus ions when they come close to the wire, so that the non-woven fabric catches them. Then, the non-woven fabric which has caught the house dust and bacteria is adequately replaced by a new one.

Note that the air cleaner is generally received in an air-permeable housing to protect the wire.

However, the electrical-discharge-type air cleaner generates ultraviolet rays due to the electric discharge between the minus ion generator and the positive/ground pole, which generates ozone. Thus, the air cleaner has a disadvantage that is the same as an ultraviolet-ray-type bactericidal lamp and an ozone generator. Moreover, it is generally overlooked that the electrical-discharge-type air cleaner generates ozone and ultraviolet rays which are harmful. Such air cleaners have been often positioned undesirably near a sleeping baby for supplying clean air.

The conventional air cleaner takes a long time until it effectively operates. For example, The time is 30 minutes to one hour for a room having a general size. Thus, persons in the room remain exposed to house dust, bacteria, and viruses, for example, due to smoking, airborne dust, and a cough of a sick person having viruses until the air cleaner operates effectively.

Another air cleaner removing house dust by a filter takes a time between 30 minutes and one hour until it operates effectively. The filter should be a specially designed one which is expensive for removing house dust consisting of particles of micron or sub-micron sizes such as tobacco smoke, bacteria, and virus. Moreover, such a filter provides a combatively larger pressure loss and requires a powerful fan, which causes an increased electrical energy and a noise problem. In addition, the filter has a shorter service life to require frequent replacements thereof. Furthermore, the filter-type air cleaner has the disadvantage that a bactericidal means is not effectively provided for sterilization of the bacteria which is caught by the filter.

For sterilization of airborne bacteria, there may be provided a means such as an ultraviolet-ray-type bactericidal lamp, an ozone generator, or an agent spraying device. An appropriate concentration of ozone generated by the bactericidal lamp is 0.1 PPM, for example in an office. However, the ozone having this concentration still irritates a mucosa of a nose, an eye, or a throat. Furthermore, the ozone provides an odor undesirable for a surrounding air. To remove the undesirable odor, an activated carbon filter is required. The ozone may cause a harmful NOx.

Meanwhile, the bactericidal lamp irradiates ultraviolet rays directly into a human body with an adverse effect. Even ultraviolet rays having a wavelength of around 260 nanometers which provides a maximum bactericidal effect require several hours to kill bacteria such as colibacillus. This is disadvantageous for a quick sterilization. In addition, the ultraviolet ray degrades a metal, a rubber, and a plastic product, and it also generates harmful ozone. An agent is not adequately sprayed in an environment in which persons are always present, and the effectiveness of the agent will not reliably continue.

SUMMARY OF THE INVENTION

In view of the above-mentioned disadvantages, an object of the invention is to provide an air cleaner and an air cleaning method according to the present invention, which allows an effective, quick air cleaning and air sterilization with no use of ozone, ultraviolet ray, and agents which are harmful and uncomfortable for persons.

For achieving the object, an air cleaner of a first aspect of the present invention includes a minus ion generator and a positive electrode. The minus ion generator uses a high minus voltage, and the positive electrode carries a high plus voltage. The minus ion generator can be positioned apart from the plus ion electrode, allowing an effective, quick air cleaning for a desired space.

Preferably, the minus ion generator has a heater, which generates effectively minus ions, allowing a quicker air cleaning.

Preferably, the positive electrode carrying the high plus voltage is positioned close to an absorbing sheet, which can effectively collect house dust which comes around the positive electrode.

An air cleaning method includes a minus ion generator and a positive electrode. The minus iongenerator carries a highminus voltage, and the positive electrode carries a high plus voltage. The method includes arrangement of the minus ion generator and the positive electrode which are positioned in a room for air-cleaning of the room. The minus ion generator is apart from the positive electrode by a distance not less than a half of the maximum distance between walls of the room. This allows a quick, effective air cleaning.

Note that the effect of the present invention may be decreased when there is provided a distance not enough for the quick air cleaning between the minus ion generator and the positive electrode.

Another air cleaner with a sterilizing function according to the present invention includes a minus ion generator and a positive electrode. The minus ion generator carries a high minus voltage, and the positive electrode carries a high plus voltage. The minus ion generator is separately positioned from the positive electrode. In a desired room, the minus ion generator is spaced from the positive electrode, allowing a quick, effective air cleaning.

Examples of the present invention will be discussed hereinafter. An air cleaner has a minus ion generator and a positive electrode which are arranged independently from each other. The minus ion generator carries a high minus voltage, and the positive electrode carries a high plus voltage. The minus ion generator is positioned apart from the positive electrode by a distance not less than a half of the maximum distance between walls of a room. This allows a quick, effective air cleaning and air sterilization.

For embodying the present invention, the minus ion generator and the positive electrode are positioned apart from each other by a distance which prevents an electrical discharge between them. An electrical discharge occurred between them generates ozone and ultraviolet rays. This requires an undesirable increased electrical power and obtains no effect of the present invention. The air cleaner according to the present invention is of an air condenser type consisting of the minus ion generator, the positive electrode, and air sandwiched therebetween. In the present invention, a ground voltage is a base (zero Volt) of the pole voltage. The ground voltage may be an earth voltage or may be a ground voltage of the room in which the air cleaner is disposed.

Preferably, the positive electrode carrying the high plus voltage is positioned close to an absorbing sheet having a comparatively broad surface. The absorbing sheet may be a needle punched fabric, a non-woven fabric, a woven fabric, or a knitted work. The absorbing sheet can catch the house dust and floating bacteria and viruses (which are called as the house dust hereinafter) effectively. Because, the house dust witch minus ions is drawn in the positive electrode side. The house dust can be easily sterilized. The catching and sterilizing operations are quick and reliable. The absorbing sheet having no electrical conductivity can provide a sufficient effect. Preferably, the absorbing sheet has an electrical conductivity so that the whole of the face of the absorbing sheet is effective for catching the house dust, allowing a quicker cleaning operation.

In addition, the absorbing sheet may be provided with or incorporated with a substance having a large service surface area for deodorizing air of the room at the same time. The substance is an activated carbon (including an activated carbon fabric and a fabric activated carbon), a silica gel, a zeolite, etc.

The absorbing sheet is required to be adequately replaced by a new one. Preferably, a rolled absorbing sheet fed by a drive roll may be used to intermittently provide anew part thereof when a part of the sheet has sufficiently absorbed the house dust. This greatly eliminates a large amount of manual works for replacement of the absorbing sheets. A timer may be provided to intermittently feed a length of the sheet every predetermined time. Alternatively, A stepping motor or a low speed motor may be provided to continuously feed the sheet.

Preferably, the absorbing sheet has initially a white or a bright color. The absorbing sheet becomes a dark color such as a dark brown or a gray when the sheet has caught the house dust. A roll motor is controlled to most adequately feed the sheet by sensing a light reflectance or transmittance rate of the sheet to know a changed color grade of the sheet.

The minus ion generator may have such a shape as a plate, straight wires, a net, a basket, or a honeycomb structure, as far as it is a striped electrode carrying a high minus voltage. Preferably, the electrode has a maximum area facing air and has a shape with a small pressure loss coefficient for an air flow, so that the electrode provides minus ions to the airborne house dust. Similarly, the positive electrode may have such a shape as a plate, straight wires, a net, a basket, or a honeycomb structure.

In the present invention, the minus ion generator carries a high minus voltage relative to a ground voltage, while the positive electrode carries a plus high voltage relative to the ground voltage. To prevent danger or to prevent the entry of large particles of dust, the air cleaner preferably has a housing provided with a protect means having air-permeability such as a net or an entrance consisting of slits. The housing may have a filter to prevent the entry of the large dust particles.

Preferably, the minus ion generator is provided with a heater. The heater heats air around it, for example to temperatures between 30° C. and 80° C. The heated air is supplied to the minus ion generator, which enables a more effective operation of the minus ionization of the house dust and the sterilization.

The minus ion generator may have an air feed means like a fan so that the house dust having the minus ions can be quickly delivered to the positive electrode side. In place of the air feed means, the heater may be positioned under the minus ion generator, or the minus ion generator may be located an air out let of an air conditioner or a vent means to maintain the same effect of the air feed means.

The air feed means may be a small fan with a smaller air feeding capacity or may be a larger one with a low rotating speed, allowing a quiet operation and a small electrical energy of the air feed means. This provides an advantage over a conventional filter-type air cleaner. That is because the minus ion generator itself has a shape with an air pressure loss coefficient, which is, for example, constituted by a large-mesh wire net or a plurality of short metal cylinders defining a honeycomb structure.

The minus ion generator and the positive electrode may be increased in number according to the shape and size of the room. Note that the minus ion generator is spaced as far as possible from the positive electrode to allow an effective removal and sterilization of the house dust.

The application voltages of the minus ion generator and the positive electrode are selected so as not to produce an electrical discharge therebetween and not to produce an electrical breakdown of a retainer of the minus ion generator.

Actually, it has been found to allow an effective removal and sterilization of the house dust that the absolute value of an application voltage of the minus ion generator is not less than the absolute value of an application voltage of the positive electrode. Furthermore, it has been found that a higher application voltage of the positive electrode produces a larger electrostatic charge in the room. The larger electrostatic charge makes persons in the room more uncomfortable due to an electrical discharge when they touch a metal like a door knob.

A minus voltage power source is provided to keep the high minus voltage of the minus ion generator, while a plus voltage power source is provided to keep the high plus voltage of the positive electrode. The power sources may be those used in a conventional air cleaner.

Note that the application voltages need not be constant but may have a small fluctuation to achieve a more effective operation of the air cleaning and bacteria removal. Such a fluctuating high voltage application is enabled by a timer circuit and a switching circuit.

DETAILED DESCRIPTION OF THE PREFERRED EMBODIMENT

Next, referring to the accompanied drawings, an embodiment of an air cleaner according to the present invention will be discussed.

Figure 1:
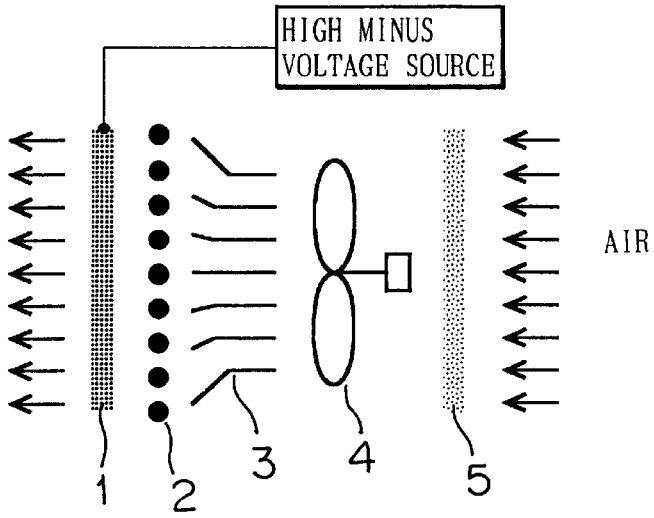
FIG. 1 is a view illustrating the concept of a module having a minus ion generator carrying a high minus voltage, the module being provided in an air cleaner according to the present invention.

FIG. 1 is a conceptual view illustrating a minus ionization module of the air cleaner. The module has an air permeable housing (not shown). The housing accommodates a minus ion generator 1, a wire-net heater 2, guide fins 3, an air fan 4, and a filter 5. The minus ion generator 1 has a wire net connected to a high minus voltage power source. The heater 2 is positioned upstream of the minus ion generator 1. The fins 3 guide air flow from the fan 4. The filter 5 prevents the entry of dust and dirt each of which has particles that can cause a short circuit between the generator 1 and the heater 2.

The minus ionization module is put on a wall of the room for air-cleaning thereof. Air in the room is moved from the filter 5 to the heater 2 via the guide fins 3 by the fan 4. The heater 2 heats the air up to an appropriate temperature (around 40° C.), and the air passes through the minus ion generator. The generator consists of a wire net or a plurality of short metal cylinders defined in a honeycomb structure which are provided with the high minus voltage from the high minus voltage power source. The minus ion generator allows minus ionization of the house dust, plus ionized particles, or particles having plus ions.

Figure 2:
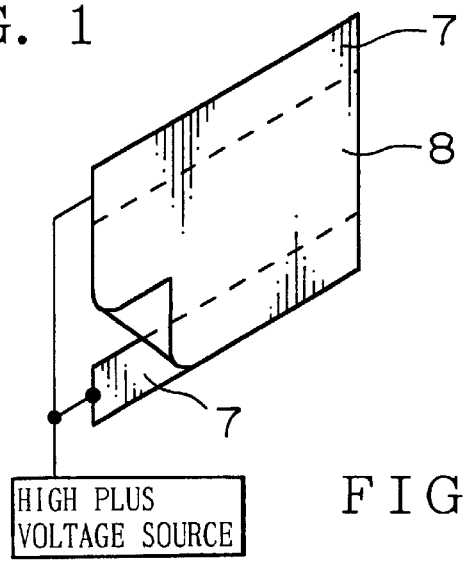
FIG. 2 is a view illustrating the concept of another module having a positive electrode carrying a high plus voltage, the module being provided in the air cleaner.

FIG. 2 is a conceptual view illustrating a positive electrode module of the air cleaner. The positive electrode module is put on another wall of the room. The positive electrode module includes a pair of positive electrodes 7 and an absorbing sheet 8 positioned close to (or to contact) the positive electrodes 7. The positive electrodes 7 maintain a high plus voltage applied by a high plus voltage power source. The absorbing sheet 8 is, for example, a non-woven fabric. The positive electrodes 7 and absorbing sheet 8 are received in a protective housing (not shown) with air-permeability.

The positive electrode module strongly draws in the house dust which has been minus-ionized by the minus ionization module. The house dust is absorbed by the absorbing sheet 8 close to the positive electrodes 7.

The house dust having the minus ions gives minus ions non-ionized house dust when the positive electrode module strongly draws in the house dust. This allows a quicker air cleaning/sterilization than the conventional air cleaner.

Furthermore, the thus constituted air cleaner will be discussed in more detail.

Figure 3:
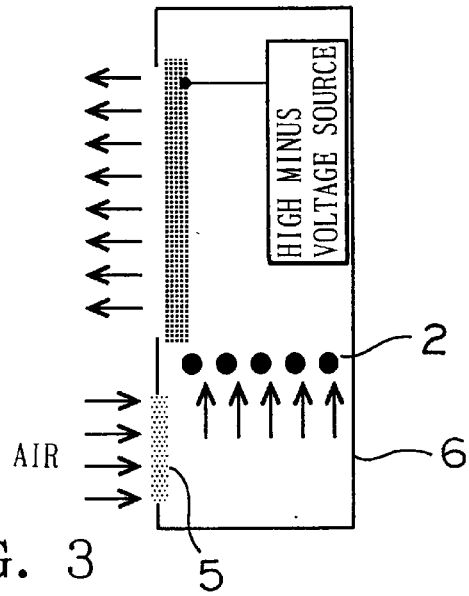
FIG. 3 is a view illustrating another minus ionization module having a minus ion generator.

FIG. 3 is a conceptual view illustrating another minus ionization module of an air cleaner having another minus ion generator. In FIG. 3, the same reference numerals as one shown in FIG. 1 designate tie same components as that of FIG. 1.

The module is received in a housing 6. The module has a filter 5, a wire-net heater 2, and a minus ion generator 1 electrically connected to a high minus voltage power source. The filter 5 prevents comparatively larger pieces of dust or the like from entering the module. An air which has passed through the filter 5 is heated by the heater 2 to go upward in the housing 6. Then, the house dust is ionized around the minus ion generator 1 and is discharged outside the housing 6. The heater 2 which produces an upward air flow is positioned under the minus ion generator 1, which eliminates a noisy machine like a fan but provides an efficient operation of the minus ionization, This embodiment is preferable for a room which requires to be quiet.

Figure 4:
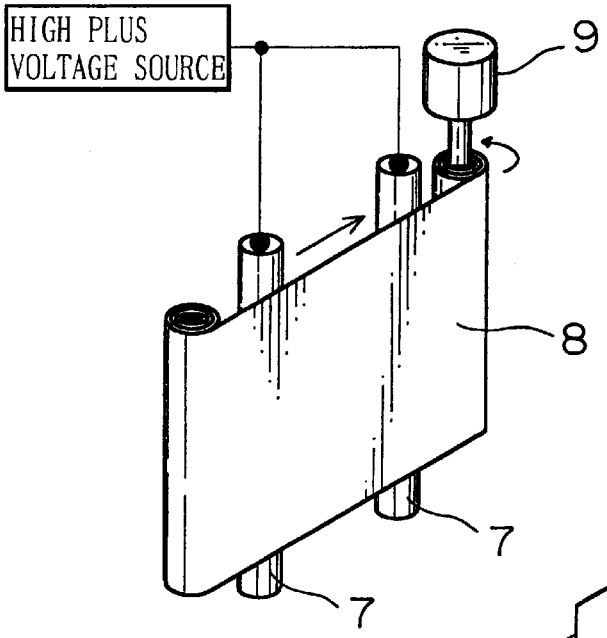
FIG. 4 is a conceptual view illustrating another module having a positive electrode carrying a high plus voltage.
Figure 5:
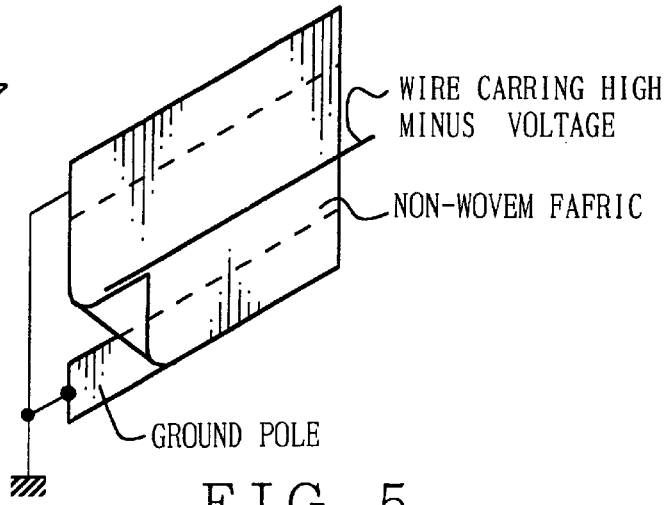
FIG. 5 (PRIOR ART)
FIG. 5 is a conceptual view illustrating a conventional air cleaner.

FIG. 4 shows another positive electrode module having a positive electrode carrying a high plus voltage.

In this module, a pair of positive electrodes 7 carrying a high plus voltage from a high plus voltage power source is positioned close to an absorbing sheet (non-woven fabric). The absorbing sheet is wound on a pair of rollers, and one of the rollers is rotated in an extremely slow speed by a motor 9. In this configuration, the house dust is absorbed on a developed part of the sheet, and, when the developed part decreases in absorbing capability, it is taken up successively so that a new part of the absorbing sheet is fed near the pair of the positive electrodes. Note that these examples are not proposed to limit the present invention.

Effects of the present invention will become definite by the descriptions of experimental data of the embodiments. The following experiments were carried out in a test clean room having a longer wall length of 2.5 m, a shorter wall length of 2.1 m, and a wall height of 2.3 m. In the room, the air temperature was between 20° C. and 23° C., and the relative humidity was between 57% and 72%.

(1) An experiment based on a conventional air cleaning method:

A commercially available ion-type air cleaner (40 cm×25 cm×30 cm) has a housing. The housing accommodates a minus ion generator carrying a high minus voltage (−8,000 Volts), a positive electrode carrying a high plus voltage (+8,000 Volts), a dust absorbing paper (12 cm×50 cm) positioned close to the positive electrode. The minus ion generator is spaced from the positive electrode by 5 to 10 cm.

After the conventional ion-type air cleaner was mounted on a middle of the longer wall of the clean room, a dusty coat was beaten to float dust in the room. At once, the ion-type air cleaner was operated, and to monitor a change of the number of dust particles in the clean room, there was provided a laser-type particle counter mounted on table having a 60 cm height. The counter is manufactured by Lion company.

Figure 6A:
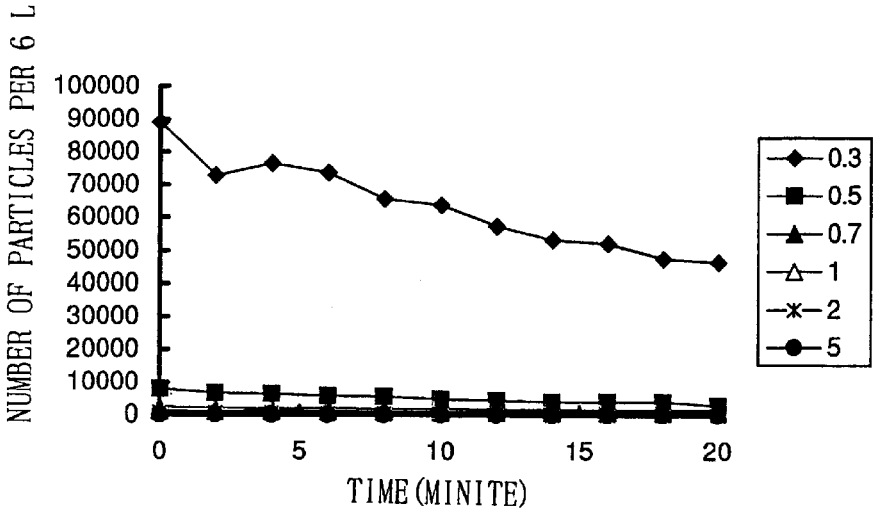
FIG. 6A (PRIOR ART)
FIGS. 6A and 6B each are a graph showing operation data of a conventional air cleaning method in which a positive electrode is positioned near a minus ion generator, FIG. 6A showing density changes of floating particles after an operation start of the method, FIG. 6B showing the same data as FIG. 6A but having a vertical coordinate of a logarithmic scale.
Figure 6B:
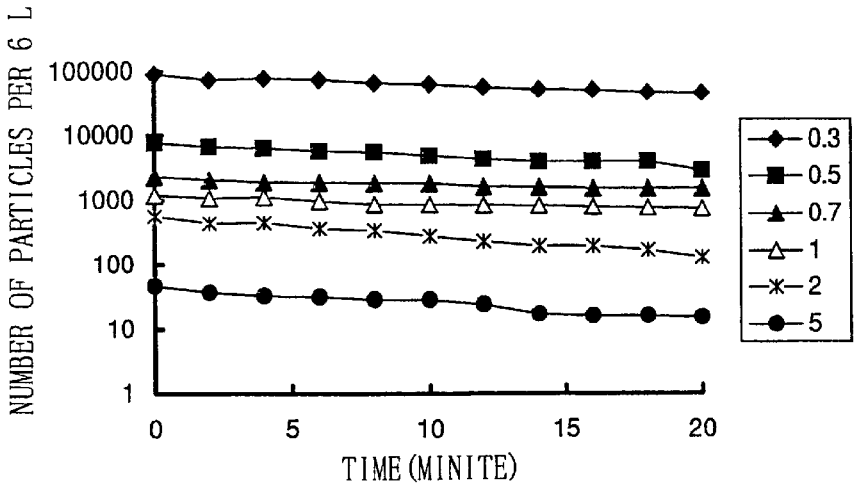
FIG. 6B (PRIOR ART)

FIGS. 6A and 6B show the monitored results. In FIG. 6A, a vertical coordinate shows the particle number per 6 liters (L) air for particles different in size, and a horizontal coordinate shows an elapsed time. Numerals of 0.3, 0.5, 0.7, 1, 2, and 5 of explanatory legends represent sequentially the numbers of the particles having diameters of 0.3 to 0.5 μm, 0.5 to 0.7 μm, 0.7 to 1 μm, 1 to 2 μm, 2 to 5 μm, and more than 5 μm. These explanatory legends will be also applied to other graphs described later.

FIG. 6B is a graph having a vertical coordinate of a logarithmic scale, which is based on the same data as FIG. 6A. Similarly, graphs of FIGS. 7B to 10B each are a graph having a vertical coordinate of a logarithmic scale.

In the same initial dust condition, when the conventional ion-type air cleaner was not operated, the monitoring of a change of a particle number of dust in the clean room was carried out for 20 minutes. The monitoring results was the same as the FIGS. 6A and 6B. The conventional ion-type air cleaner, in which the minus ion generator is positioned near the positive electrode, provides no quick effects of the dust cleaning.

Furthermore, an electrical discharge might occur in the conventional air cleaner. A gas detection tube sensed ozone of a 0.1 to 0.3% concentration. At a point about 10 cm apart from the cleaner and at another point further apart from the cleaner, an undesirable odor of ozone was present.

Similarly, the monitoring of a change of the number of live-bacteria in the clean room was carried out. An in-air bacteria sampler (manufactured by SHIBATA GRASS Ltd.) samples bacteria in the clean room for five minutes at a point 1 m above a floor of the room. Then, the sampled bacteria were cultivated at 35° C. for 48 hours in a mannite salt cultivation medium. The resulting grown colonies were counted to monitor the number of live-bacteria.

The sampling was carried out at three different times, that is, just after the dust provision, 3.5 hours later, and 7 hours later. The resulting numbers of live-bacteria were 110, 85, and 50 sequentially.

(2) An experiment based on another air cleaning method:

A minus ion generator like one shown in FIG. 3 was mounted on a middle of a shorter side wall. The minus ion generator has a minus electrode consisting of 27 aluminum cylinders defining a honeycomb structure. The cylinder has a 18 mm outer diameter, a 16 mm inner diameter, and a length of 3 cm. Near the minus electrode, there was provided a fan which can supply air at a 3 $m^3$/minute flow rate. At a middle of another shorter side wall of the room, a positive electrode made of a 60 cm×60 cm stainless steel plate was arranged 10 cm apart from the wall. The following experiments were carried out based on the minus ion generator and positive electrode which were thus arranged in the clean room.

After the dust provision in the clean room, the monitoring of a change of a particle number of dust in the clean room was carried out, while the positive electrode was carrying a ground voltage and the minus electrode was carrying −12,500 Volts. The monitored results are shown in FIG. 7A and FIG. 7B.

Figure 7A:
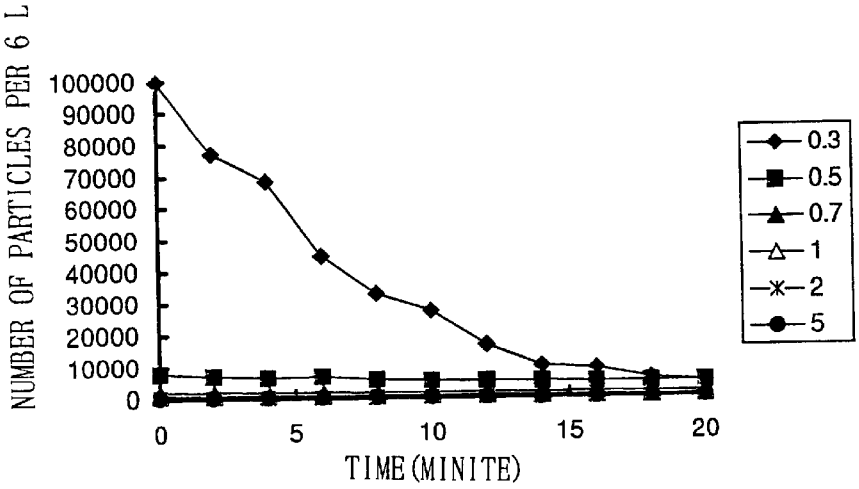
FIGS. 7A and 7B each are a graph showing an operational effect data of another conventional air cleaning method in which a minus ion generator is provided, FIG. 7A showing density changes of floating particles after operation start of the method, FIG. 7B showing the same data as FIG. 7A but having a vertical coordinate of a logarithmic scale.
Figure 7B:
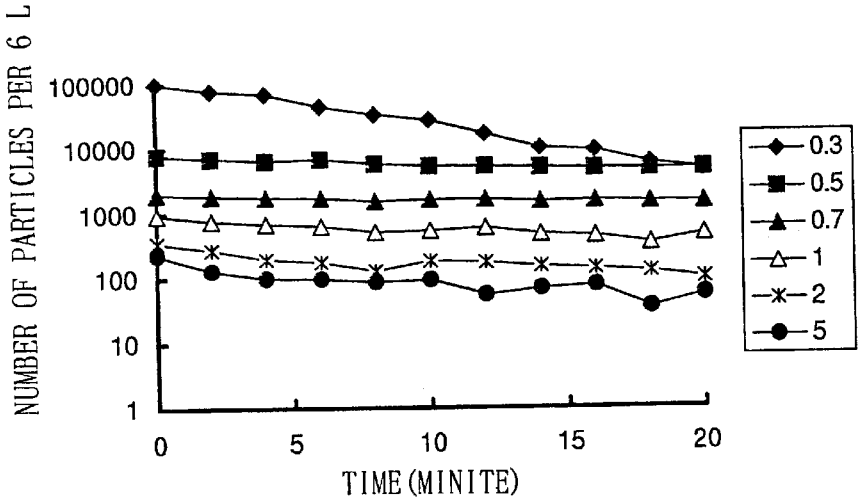

Referring to FIGS. 7A and 7B in comparison with FIGS. 6A and 6B, the dust particles having 0.3 μm to 0.5 μm diameters were found to be removed most quickly. It took only about 14 minutes to decrease the initialparticle density up to one-tenth thereof. However, there were found almost no effects for the particles having diameters more than 0.5 μm. Each group of the particle having diameters more than 0.5 μm maintained a density more than one-tenth of the initial one for 20 minutes. It is noted that there was neither ozone detection nor ozone odor around the positive electrode and the minus ion generator.

(3) A comparative example, in which the absolute value of the high plus voltage applied to the positive electrode is larger than the absolute value of the high minus voltage applied to the minus ion generator:

After the dust provision in the clean room, the monitoring of a change of a particle number of dust in the clean room was carried out, while the positive electrode was carrying 10,000 Volts and the minus electrode was carrying −5,000 Volts. The monitored results are shown in FIG. 8A and FIG. 8B.

Figure 8A:
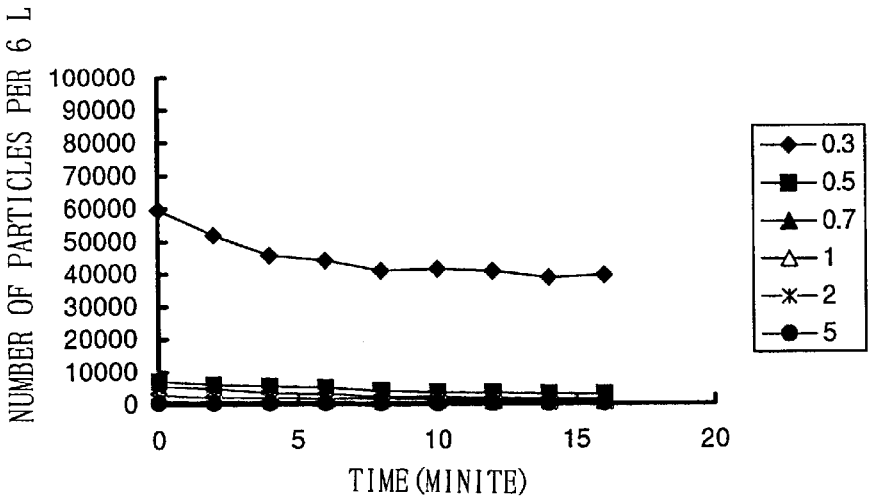
FIGS. 8A and 8B each are a graph showing an operational effect data of a comparative example of a conventional air cleaning method in which the absolute value of the high plus voltage applied to the positive electrode is larger than the absolute value of the high minus voltage applied to the minus ion generator, FIG. 8A showing density changes of floating particles after operation start of the method, FIG. 8B showing the same data as FIG. 8A but having a vertical coordinate of a logarithmic scale.
Figure 8B:
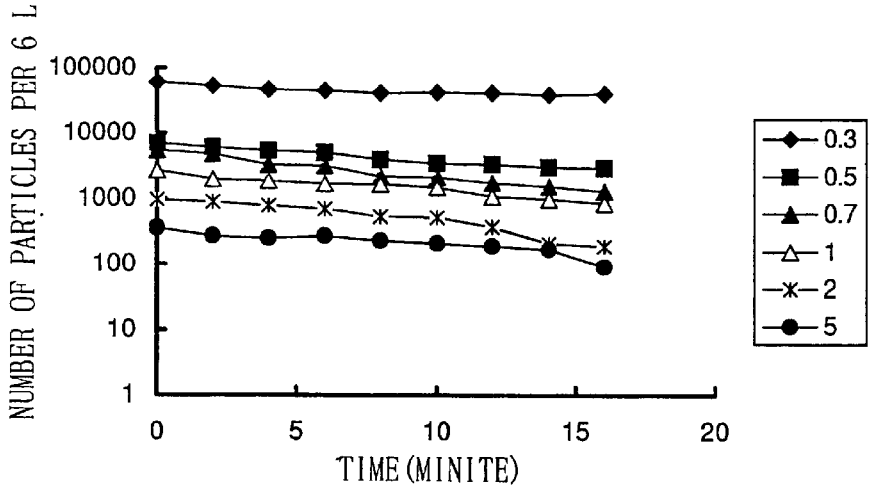

Referring to FIGS. 8A and 8B in comparison with FIGS. 6A, 6B, 7A, and 7B, there were found almost no effects for the particles of every size group. Each group of the particles maintained a density more than one-tenth of the initial one for 20 minutes. Note that a person who entered the room experienced an electrostatic discharge from his finger to feel discomfort just before he touched a metal door knob. However, there were neither ozone detection and nor ozone odor around the positive electrode and the minus ion generator. The fan required an extremely small power of 5.5 watt with a remarkably reduce noise.

(4) An embodiment 1, in which the absolute value of the high plus voltage applied to the positive electrode is equal to the absolute value of the high minus voltage applied to the minus ion generator:

After the dust provision in the clean room, the monitoring of a change of a particle number of dust in the clean room was carried out, while the positive electrode was carrying 8,000 Volts and the minus electrode was carrying −8,000 Volts. The monitored results are shown in FIG. 9A and FIG. 9B.

Figure 9A:
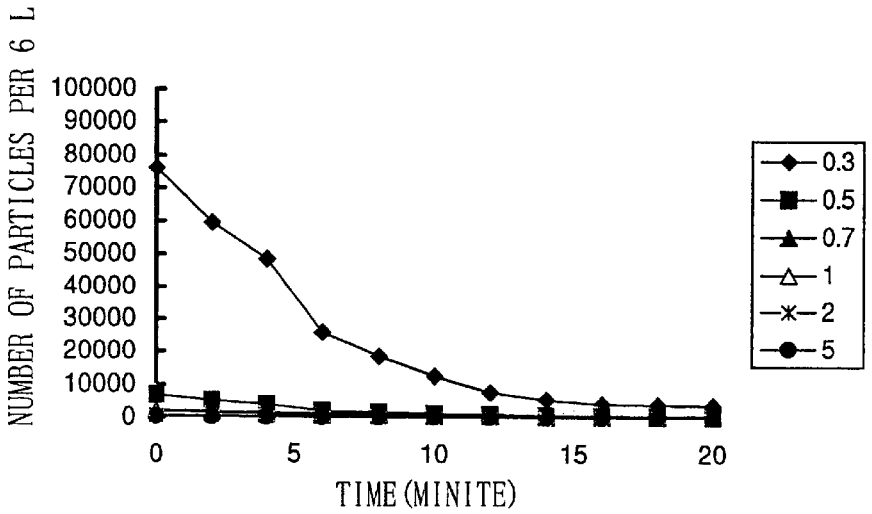
FIGS. 9A and 9B each are a graph showing an operation data of an embodiment 1 in which the absolute value of the high plus voltage applied to the positive electrode is equal to the absolute value of the high minus voltage applied to the minus ion generator, FIG. 9A showing density changes of floating particles after an operation start of the method, FIG. 9B showing the same data as FIG. 9A but having a vertical coordinate of a logarithmic scale.
Figure 9B:
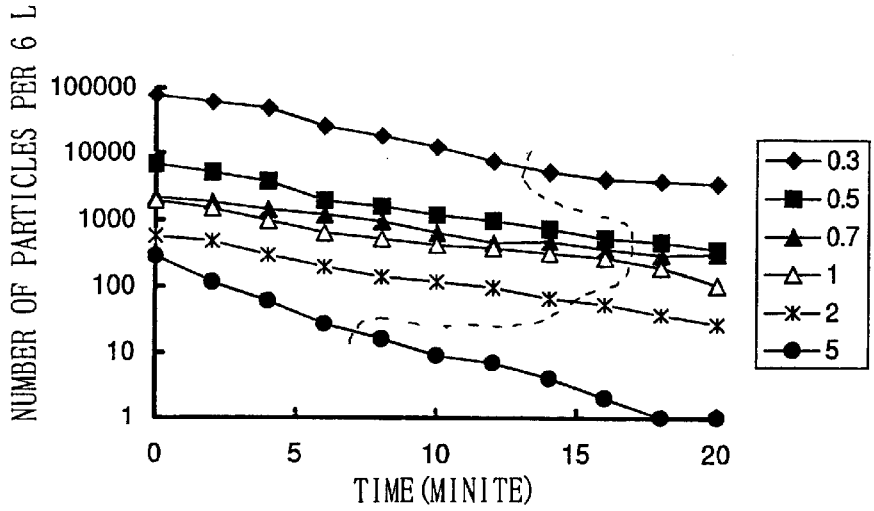

Referring to FIGS. 9A and 9B in comparison with FIGS. 6A to 7A and 8A to 8B, every group of the dust particles were found to be removed quickly. Advantageously, it took only about 7 to 17 minutes to decrease the initial particle density up to one-tenth thereof as illustrated by a dotted line of FIG. 9B. Note that a person who entered the room experienced no electrostatic charges to feel discomfort. There were neither ozone detection and nor ozone odor around the positive electrode and the minus ion generator.

At the same time, the monitoring of a change of the number of live-bacteria in the clean room was carried out. The monitoring was carried out at three different times, that is, just after the dust provision, 3.5 hours later, and 7 hours later. The resulting numbers of live-bacteria were 110, 80, and 35 sequentially.

(5) An embodiment 2, in which the absolute value of the high plus voltage applied to the positive electrode is twice (or 2.5 times) the absolute value of the high minus voltage applied to the minus ion generator:

After the dust provision in the clean room, the monitoring of a change of a particle number of dust in the clean room was carried out, while the positive electrode was carrying 5,000 Volts and the minus electrode was carrying −12,500 Volts. The monitored results are shown in FIG. 10A and FIG. 10B.

Figure 10A:
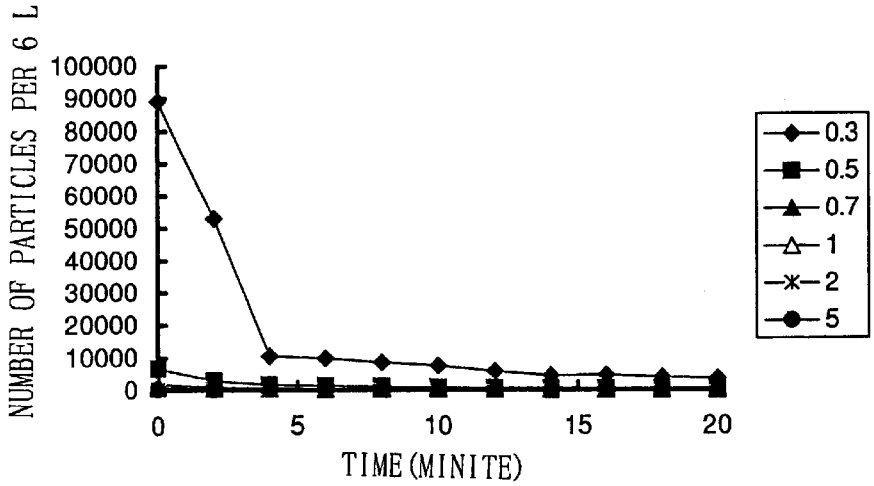
FIGS. 10A and 10B each are a graph showing an operation data of an embodiment 2, in which the absolute value of the high plus voltage applied to the positive electrode is twice (or 2.5 times) the absolute value of the high minus voltage applied to the minus ion generator, FIG. 10A showing density changes of floating particles after operation start of the method, FIG. 10B showing the same data as FIG. 10A but having a vertical coordinate of a logarithmic scale.
Figure 10B:
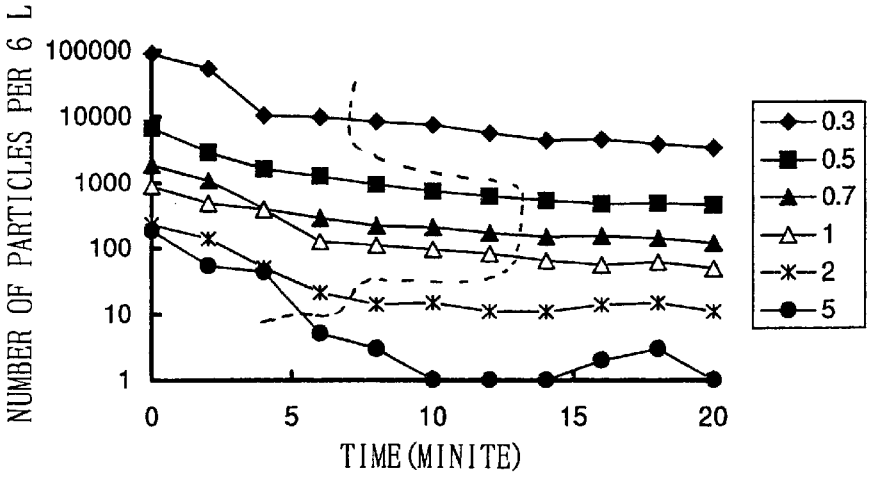

Referring to FIGS. 10A and 10B in comparison with FIGS. 6A to 9A and 6A to 9B, every group of the dust particles were found to be removed extremely quickly. Advantageously, it took only about 7 to 13 minutes to decrease the initial particle density up to one-tenth thereof as illustrated by a dotted line of FIG. 10B. Note that a person who entered the room experienced no electrical charges to feel discomfort. There were neither ozone detection and nor ozone odor around the positive electrode and the minus ion generator.

At the same time, the monitoring of a change of the number of live-bacteria in the clean room was carried out. The monitoring was carried out at three different times, that is, just after the dust provision, 3.5 hours later, and 7 hours later. The resulting numbers of live-bacteria were 115, 8, and 0 (zero) sequentially.

Now, referring to advantageous effects of the present invention, the air cleaner or the air cleaner with sterilization allows a quick removal of the house dust and airborne bacteria related to allergy or infectious diseases. The air cleaner generates no ozone causing an undesirable odor, discomfort, or irritation for a nose mucosa. Furthermore, the air cleaner requests no chemical agent nor ultraviolet rays which are harmful for a human body and degrades a product body made of a rubber or a plastic material.

What is claimed is:

1. An air cleaner for cleaning house dust which comprises:

a minus ion generator carrying a high minus voltage; and a positive electrode carrying a high plus voltage, the high plus voltage being at least 4,000 volts and an absolute value of the high minus voltage being larger than an absolute value of the high plus voltage, the air cleaner further comprises a dust absorbing sheet positioned adjacent the positive electrode, the minus ion generator being spaced apart from the positive electrode by a distance that is at least half of a maximum distance between walls of a room which surround the air cleaner.

2. The air cleaner set forth in claim 1, wherein the minus ion generator comprises a heater.

3. The air cleaner set forth in claim 1, wherein the absolute value of the high minus voltage is larger than twice the absolute value of the high plus voltage.

4. The air cleaner set forth in claim 1, wherein the high plus voltage is larger than 5,000 volts and the absolute value of the high minus voltage is larger than 2.5 times the absolute voltage of the high plus voltage.

5. The air cleaner set forth in claim 1 further comprising a timer circuit and a switching circuit which provide at least one of the high minus voltage and the high plus voltage with an intentional fluctuation.

6. The air cleaner set forth in claim 1, wherein the minus ion generator comprises a wire net.

7. The air cleaner set forth in claim 1, wherein the minus ion generator comprises a plurality of metal cylinders arranged in a honeycomb configuration.

8. The air cleaner set forth in claim 1 further comprising a pair of rollers on which the absorbing sheet is wound and a motor for rotating one of the rollers.

9. The air cleaner set forth in claim 1 further comprising a fan positioned near the minus ion generator.

10. An air cleaning method for cleaning house dust which comprises:

providing a minus ion generator carrying a high minus voltage and a positive electrode carrying a high plus voltage of at least 4,000 volts, wherein an absolute value of the high minus voltage is larger than an absolute value of the high plus voltage;

providing an absorbent sheet adjacent the positive electrode;

positioning the minus ion generator and the positive electrode in a room for cleaning air in the room so that the minus ion generator is spaced apart from the positive electrode by a distance of at least half of a maximum distance between walls of the room.

11. The method set forth in claim 10, wherein the absolute value of the high minus voltage is larger than twice the absolute value of the high plus voltage.

12. The method set forth in claim 10, wherein the minus ion generator comprises a heater for heating air passing through the minus ion generator.

13. An air cleaner with a sterilization function for cleaning house dust which comprises:

a minus ion generator carrying a high minus voltage; and a positive electrode carrying a high plus voltage, the high plus voltage being at least 4,000 volts and an absolute value of the high minus voltage being larger than an absolute value of the high plus voltage, the minus ion generator being spaced apart from the positive electrode by a distance that is at least half of a maximum distance between walls of a room which surround the air cleaner.

14. The air cleaner set forth in claim 13, wherein the minus ion generator comprises a heater for heating air passing through the minus ion generator.

15. The air cleaner set forth in claim 14, wherein the heater is capable of heating the air passing through the minus ion generator to a temperature of 30 to 80° C.

* * * * *